United States Patent [19]

Arney et al.

[11] Patent Number: 4,684,185

[45] Date of Patent: Aug. 4, 1987

[54] APPARATUS FOR ATTACHING CABLE TO A KEYBOARD

[75] Inventors: Michel D. Arney, Lowell; Clifford E. LaCount, Townsend, both of Mass.

[73] Assignee: Wang Laboratories, Inc., Lowell, Mass.

[21] Appl. No.: 794,208

[22] Filed: Nov. 1, 1985

[51] Int. Cl.[4] ..... H01R 11/00

[52] U.S. Cl. ..... 439/502; 439/451

[58] Field of Search ..... 339/28, 29, 119 C, 147 C, 339/104

[56] References Cited

U.S. PATENT DOCUMENTS 1,968,884 8/1934 Gilbert ..... 339/104

3,535,638 10/1970 Michelin ..... 339/28

*Primary Examiner*—Gil Weidenfeld

*Assistant Examiner*—Paula A. Austin

*Attorney, Agent, or Firm*—Michael H. Shanahan; Gordon E. Nelson

[57] ABSTRACT

Apparatus for removably attaching a cable to a point on another piece of apparatus. The apparatus consists of means such as a jack for attaching an end of the cable to the piece of apparatus and a clip at another point on the piece of apparatus which may be employed at the option of the user of the piece of apparatus to retain an intermediate point of the cable. The cable may be inserted in and removed from the clip without use of tools. The attaching apparatus is employed in devices such as keyboards for the cables which attach the keyboard to the rest of the system and auxiliary input devices to the keyboard. In a preferred embodiment, the clip consists of a short channel in the case of the keyboard which will accept a number of cables having different sizes and a flexible snap which retains the cables in the channel.

14 Claims, 5 Drawing Figures

: BOTTOM VIEW OF KB201 OF THE PRESENT INVENTION

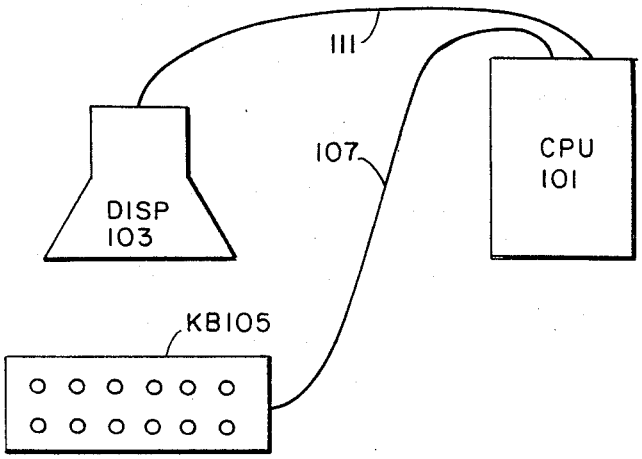
FIG. 1: TYPICAL SMALL COMPUTER SYSTEM 109 WITH KEYBOARD
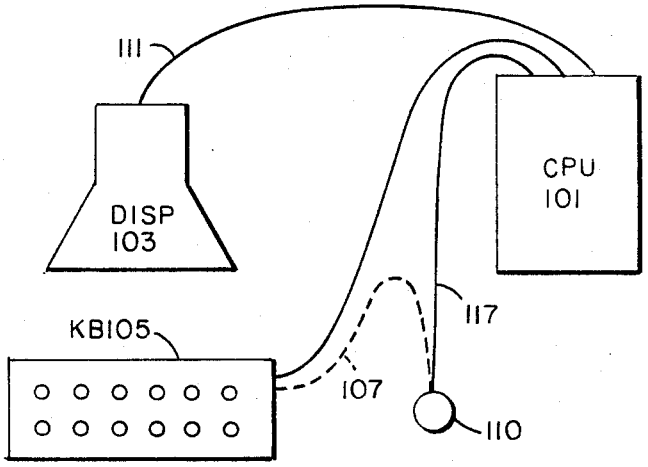
FIG. 1B: PRIOR-ART SYSTEM 109 WITH AUXILIARY INPUT DEVICE
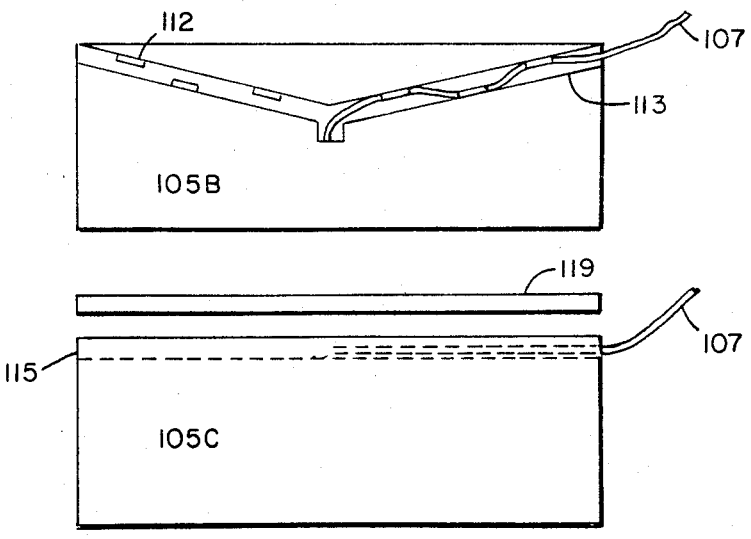
FIG. 1A: PRIOR-ART CABLE ATTACHMENT SYSTEMS

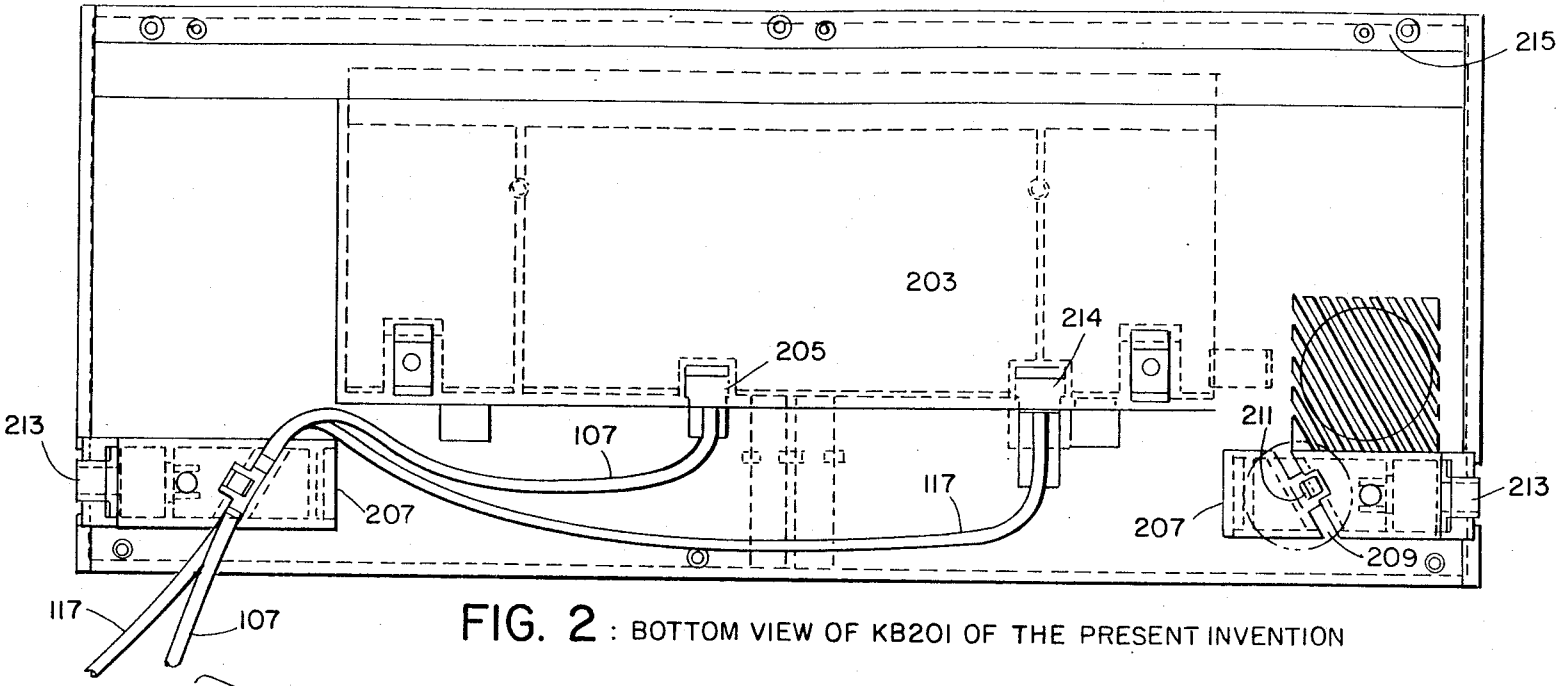
FIG. 2: BOTTOM VIEW OF KB201 OF THE PRESENT INVENTION
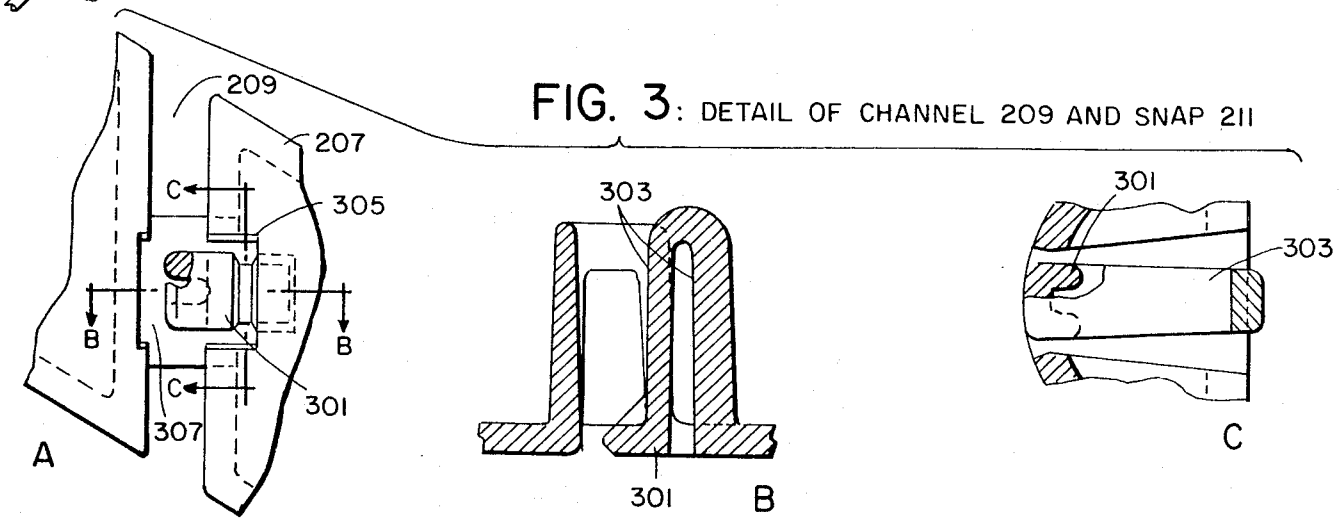
FIG. 3: DETAIL OF CHANNEL 209 AND SNAP 211

APPARATUS FOR ATTACHING CABLE TO A KEYBOARD

BACKGROUND OF THE INVENTION

1. Field of the Invention

The present invention relates to apparatus used to attach a cable, and more specifically to apparatus used to attach a cable to a keyboard.

2. Description of the Prior Art: FIG. 1

For many years, keyboards were integral parts of the devices with which they were used. However, as keyboards used with digital devices began to respond to keystrokes by transmitting digital codes, the only connection required between the keyboard and the digital device was a cable. Consequently, keyboards began to appear which were independent entities and which were connected to the digital device solely by means of the cable. Such keyboards rapidly became popular, since they permitted the user of the digital device to put the keyboard wherever he pleased.

Systems using independent keyboards typically have the form shown in FIG. 1. Small computer system 109 of that figure has three separate parts: CPU 101, which contains the central processing unit, DISP 103, which contains the CRT display for the system, and keyboard (KB) 105, which is the keyboard for the system. DISP 103 is connected to CPU 101 by cable 111 and KB 105 is connected thereto by cable 107. KB 105, DISP 103, and CPU 101 may have any locations relative to each other which is convenient for the user of the system.

One limitation on the freedom of the user to arrange his system as he pleases has been the fact that in most KBs 105, a user of the system cannot change the point at which cable 107 is connected to KB 105. For example, in the KB 105 of FIG. 1, cable 107 is permanently attached to the upper right hand corner of KB 105. While that arrangement is advantageous when system 109 is arranged as shown in FIG. 1, it is not advantageous if CPU 101 is located to the left of DISP 103, since in that case, cable 107 must either be long enough to run behind DISP 103 or must cross the desk area between KB 105 and DISP 103.

As shown in FIG. 1A, some prior art KBs 105 have permitted a user of KB 105 to choose which corner cable 107 would be attached to. FIG. 1A presents bottom views of two KBs 105, KB 105B and KB 105C. The bottom of KB 105B contains Y-shaped channel 113. The location at which cable 107 is plugged into KB 105B is at the base of channel 113, and the branches of channel 113 have tabs 112 which retain cable 107 in channel 113. When a user of KB 105B sets up his system, he plugs cable 107 in at the base of channel 113 and chooses which corner of KB 1058 he wishes cable 107 to be attached to. He then pushes cable 107 around tabs 112 into the branch of channel 113 which ends at the proper corner of KB 105B. As may be seen from the foregoing description, the operation of attaching the cable, while not difficult, is time consuming.

Another arrangement permitting cable 107 to emerge from either corner of KB 105 is shown in KB 105C. There, the back of KB 105C contains a channel 115 which is covered by snap-on cover 119. Cable 107 is plugged into KB 105C in the center of channel 115. The user of KB 105C runs cable 107 through channel 115 to the desired corner of KB 105C and then snaps cover 119 onto channel 115 to retain cable 107 in channel 115.

Again, the operation of attaching the cable, while not difficult, is time consuming.

The arrangements employed in KBs 105B and 105C are intended only to permit the user some choice when he originally sets up his system; they are too time consuming to serve users who wish to reconfigure cable 107 while using his KB 105. The need for such reconfiguration has increased as KB 105 has itself been used as a point of attachment for auxiliary input devices such as a mouse, a joy stick, or a pressure-senitive pad. FIG. 1B shows a prior-art system 109 with mouse 110. Generally speaking, cable 117 for mouse 110 is connected to CPU 101; however, in some systems, cable 117 is connected to KB 105, as shown by the dotted lines in FIG. 1B. The latter arrangement is particularly advantageous when CPU 101 is under the user's desk or at some other relatively inaccessible location.

The mouse, joy stick, or pad is generally not as frequently used as the keyboard, and must therefore be easily detachable. Moreover, all of these devices are designed to be used with one hand, and consequently, their locations with respect to the keyboard will depend on whether the user is right or left handed. For these reasons, it is even less desirable to limit attachment of the cables for these devices to a single point on the keyboard than it is to so limit the attachment of cable 107 for the keyboard itself. Moreover, the fact that more than one cable is connected to the keyboard has further limited the utility of prior-art attachment systems. For example, the tabs 12 used in channel 113 of FIG. 1A must be designed for a single size of cable. If, as is often the case, cable 107 is of a different size than cable 117, one of them will either not fit into or fall out of channel 113.

What is needed, and what the invention disclosed herein provides, is a way of attaching cables to apparatus which is easy, flexible, inexpensive, and permits attachment of several cables having different sizes.

SUMMARY OF THE INVENTION

The invention generally permits user of a piece of apparatus which is connected by cable to another piece of apparatus to select one of several alternative locations on the case of the apparatus for the attachment of a cable and attach the cable at that point without interfering with the electrical connections between the apparatus and the cable. In the invention, first means are provided for attaching one end of the cable to the apparatus. The means may be a jack or one of the standard techniques used to attach a cable to the case of an electrical device. Second means are provided on the case which permit optional attachment of an intermediate point on the cable to the case without the use of tools. The user attaches an intermediate point of the cable to whichever of the second means is best for his present use of the apparatus, and the apparatus behaves with relation to the cable as if the only point of physical attachment to the cable was the intermediate point.

When the apparatus is used with a keyboard, the second attachment means are typically placed in the vicinity of the ends of the side of the keyboard opposite the keyboard user, thus effectively permitting attachment of the intermediate point of the cable at either of the top corners of the keyboard. In a preferred embodiment, the keyboard may have a cable for a device such as a mouse connected to it in addition to the cable for the keyboard. In this embodiment, the second attachment means will accomodate both cables, making it possible to have both cables attached to the same corner of the keyboard, each attached to a different corner, only one cable attached to a corner, or neither cable attached to a corner. The second attachment means may have many forms. One useful form involves short channels in the bottom of the keyboard at the points of attachment for the cable and a flexible snap which holds the cable in the channel. The user of the keyboard attaches his cable at the second attachment point by pushing it past the snap into the channel; to detach it, he pulls the cable out of the channel past the snap. The channel is deep enough to permit more than one cable to be inserted therein.

It is thus an object of the invention to provide improved apparatus for attaching a cable.

It is another object of the invention to provide a keyboard in which a cable may be attached to more than one point.

It is an additional object of the invention to provide apparatus permitting a user to attach a plurality of cables to one or more points on the case of electrical apparatus.

It is a further object of the invention to provide apparatus permitting the flexible attachment of a pointing device such as a mouse to a keyboard.

Other objects and advantages of the present invention will be understood by those of ordinary skill in the art after referring to the detailed description of a preferred embodiment and the drawings, wherein:

BRIEF DESCRIPTION OF THE DRAWINGS

FIG. 1 is a conceptual drawing of a typical small computer system with a keyboard;

FIG. 1A is a diagram of two prior-art cable attachment systems;

FIG. 1B is a diagram of a prior-art small computer system with a mouse;

FIG. 2 is a bottom view of a keyboard incorporating the present invention.

FIG. 3 is a detailed view of the snap used to retain the cable in the present invention.

Reference numbers in the drawings have three digits. The most significant digit is the number of the drawing in which the item referred to by the reference number first appears; thus, reference number 105 refers to an item which first appears in FIGS. 1, 1A, or 1B.

DESCRIPTION OF A PREFERRED EMBODIMENT: FIGS. 2 AND 3

FIG. 2 is a bottom view of the case of a keyboard (KB) 201 which employs the present invention. Edge 215 is at the "bottom" of KB 201, i.e, the side closest to a user typing on the keyboard. Legs are attached to leg attachment points 213, and when KB 201 is in use, it is supported above the surface it is used on by the legs and by edge 215. The bottom surface of KB 201 is molded of plastic and is generally flat except for triangular prism 203 and cable retainers 207. Triangular prism 203 houses jack 205 for cable 107 connecting KB 201 to CPU 101 and jack 214 for cable 117 connecting mouse 110 or another such device to KB 201. In a preferred embodiment, both jacks are standard telephone-type jacks. Cable retainers 207 in a preferred embodiment have the form of half cylinders whose flat side rests on the flat bottom surface of KB 201. Each cable retainer 207 has passing through it channel 209. Channel 209 can accept either cable 107, cable 117, or both. The cables are retained in channel 209 by flexible snap 211. A cable may be placed in channel 209 by pushing it past snap 211 into channel 209 and removed therefrom by pulling it past snap 211. Channel 209 is sufficiently keep to contain more than one cable. Further, because snap 211 is flexible, it will retain cables of differing diameters in channel 209.

FIG. 3 presents three detailed views of channel 209 and snap 211 in a preferred embodiment. The view marked A is a detailed view from above; the view marked B is a cross section taken on the line in view A marked B—B, and the view marked C is a cross section taken on the line in view A marked C—C. As can be seen from those views, snap 211 in a preferred embodiment is molded in one piece with the piece of plastic from which the portion of retainer 207 on one side of channel 209 is formed. The parts of snap 211 consist of head 301 and flexible shank 303, which is connected to a wall of the portion of retainer 207 to which snap 211 is connected. There is further a gap 307 between head 301 and one wall of channel 209 and a notch 305 in the other wall of channel 201 which permits lateral motion of head 301. As may be seen most clearly in view B, head 301 has a blunt point protruding out into gap 307. When a cable is pressed into or pulled out of channel 209, the point directs the cable into gap 307 and the pressure of the cable on the point exerts lateral pressure on head 301. In response to the lateral pressure, flexible shank 303 bends and head 301 moves into notch 305, permitting gap 307 to increase in width until the cable moves past head 301 and into or out of channel 209.

While the preferred embodiment of the cable retainer is employed in a keyboard, the retainer may be used with other forms of apparatus as well. For example, it might be used to attach a cable from a bar scanner to a device such as a cash register. Forms of the cable retainer other than that of the preferred embodiment are also possible. For example, a turnbuckle, a flexible tab, or other movable component might be used instead of snap 211 to hold the cable in the retainer. Moreover, the entire retainer might consist of a flexible clip which would accept and retain the cable at an intermediate point. In the preferred embodiment, retainer 207 may have a form other than that of a half cylinder, and snap 211 need not be an integral component of part of retainer 207. Materials other than plastic are also possible. Thus, the preferred embodiment described herein is to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. Cable attachment means for attaching a cable to an apparatus comprising:

first cable retention means by which one end of the cable is attached to the apparatus and second cable retention means for attaching an intermediate point in the cable to the apparatus, the second cable retention means including a channel in the apparatus for accepting the cable and movable means movable without use of tools for retaining the cable in the channel.

2. In the cable attachment means of claim 1 and wherein:

the cable is optionally attached to the second cable retention means.

3. In the cable attachment means of claim 1 and wherein:

the second cable retention means attaches the cable in the vicinity of a corner of the apparatus.

4. In the cable attachment means of claim 1 and wherein:

the movable means for retaining the cable in the channel is flexible snap means for permitting the cable to be inserted the channel, retaining the cable therein, and permitting removal of the cable from the channel.

5. In the cable attachment means of claim 4 and wherein:

the flexible snap means is integral with a wall of the channel.

6. Cable attachment means for attaching a plurality of cables to apparatus comprising:

first cable retention means corresponding to each of the plurality of cables by which one end of each of the plurality of cables is attached to the apparatus and second cable retention means for attaching an intermediate point of one or more of the plurality of cables to the apparatus, the second cable retention means including a channel in the apparatus for accepting the one or more cables and movable means movable without tools for retaining the one or more cables in the channel.

7. In the cable attachment means of claim 6 and wherein:

the one or more cables is optionally attached to the second cable retention means.

8. In the cable attachment means of claim 6 and wherein:

the second cable retention means attaches the one or more cables in the vicinity of a corner of the apparatus.

9. In the cable attachment means of claim 6 and wherein:

the movable means for retaining the one or more cables in the channel is flexible snap means for permitting the one or more cables to be inserted in the channel, retaining the one or more cables therein, and permitting removal of the one or more cables from the channel.

10. In the cable attachment means of claim 9 and wherein:

the flexible snap means is integral with a wall of the channel.

11. Means for attaching a cable to a keyboard comprising:

first cable retention means for attaching an end of the cable to a point on the keyboard other than in the vicinity of either end of the side of the keyboard opposite a user thereof; and second cable retention means for optionally attaching an intermediate point of the cable in the vicinity of an end of the side of the keyboard opposite a user therof, the second cable retention means permitting detachment of the cable therefrom without tools and including two cable retention means, one located in the vicinity of each end of the side of the keyboard opposite the user thereof, whereby the intermediate point may be optionally attached at either of the two cable retention means.

12. In the cable attachment means of claim 11 and wherein:

the first cable retention means attaches the end of the cable to the bottom of the keyboard and the second cable retention means includes a channel in the bottom of the keyboard for accepting the cable and movable means for retaining the cable in the channel.

13. Cable attachment means for attaching a first cable from a digital computer system and a second cable from an auxiliary input device to a keyboard comprising:

first cable retention means for attaching the end of the first cable to the keyboard;

second cable retention means for attaching the end of the second cable to the keyboard;

third cable retention means located in the vicinity of one end of the side of the keyboard opposite the user thereof for optionally attaching an intermediate point of either the first or second cable or both to the keyboard; and fourth cable retention means located in the vicinity of the other end of the side of the keyboard opposite the user thereof for optionally attaching an intermediate point of either the first or second cable or both to the keyboard, attachment and detachment of the first and second cables from the third and fourth cable retention means being without use of tools.

14. In the cable attachment means of claim 13 and wherein:

the first and second cable retention means attach the ends of the first and second cables to the bottom of the keyboard and each of the third and fourth cable retention means includes a channel in the bottom of the keyboard for accepting the cable and movable means for retaining the cables in the channel.

* * * * *